US008043079B2

(12) United States Patent
Yoo et al.

(10) Patent No.: US 8,043,079 B2
(45) Date of Patent: Oct. 25, 2011

(54) HERMETIC COMPRESSOR AND REFRIGERATION CYCLE DEVICE HAVING THE SAME

(75) Inventors: Byung-Kil Yoo, Seoul (KR); Nam-Kyu Cho, Seoul (KR); Dong-Koo Shin, Seoul (KR); Yang-Hee Cho, Seoul (KR); Hyo-Keun Park, Seoul (KR); Cheol Hwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 367 days.

(21) Appl. No.: 12/181,989

(22) Filed: Jul. 29, 2008

(65) Prior Publication Data

US 2009/0035160 A1 Feb. 5, 2009

(30) Foreign Application Priority Data

Jul. 30, 2007 (KR) ..... 10-2007-0076579
Dec. 27, 2007 (KR) ..... 10-2007-0139286
Jul. 18, 2008 (KR) ..... 10-2008-0070335

(51) Int. Cl.
*F04C 2/00* (2006.01)
*F04C 15/00* (2006.01)

(52) U.S. Cl. ..... 418/88; 418/55.1; 418/55.6; 418/94; 418/270; 418/DIG. 1; 417/310; 184/6.16

(58) Field of Classification Search ..... 418/88, 418/94, 97–99, 55.1–55.6, 57, 100, 270, 418/DIG. 1; 417/310, 410.5, 902; 184/6.16–6.18
See application file for complete search history.

(56) References Cited

U.S. PATENT DOCUMENTS

| | | | | |
|---|---|---|---|---|
| 3,796,522 | A * | 3/1974 | Oshima et al. | 418/15 |
| 5,277,564 | A * | 1/1994 | Tamura et al. | 418/55.6 |
| 6,045,344 | A | 4/2000 | Tsuboi et al. | |
| 6,533,561 | B1 | 3/2003 | Furusho et al. | |
| 7,494,329 | B2 * | 2/2009 | Yoo et al. | 418/88 |
| 7,632,081 | B2 * | 12/2009 | Yoo et al. | 418/88 |
| 7,717,688 | B2 * | 5/2010 | Yoo et al. | 418/88 |
| 2007/0071627 | A1 | 3/2007 | Lee et al. | |
| 2007/0160488 | A1 | 7/2007 | Yoo et al. | |
| 2007/0160489 | A1 | 7/2007 | Yoo et al. | |

FOREIGN PATENT DOCUMENTS

| | | | |
|---|---|---|---|
| CN | 1212333 | A | 3/1999 |
| CN | 1342247 | A | 3/2002 |
| CN | 2813936 | Y | 9/2006 |
| CN | 1975168 | A | 6/2007 |
| EP | 0809029 | A2 | 11/1997 |
| EP | 0949465 | A2 | 10/1999 |

(Continued)

*Primary Examiner* — Theresa Trieu
(74) *Attorney, Agent, or Firm* — Birch, Stewart, Kolasch & Birch, LLP

(57) ABSTRACT

A hermetic compressor and a refrigeration cycle device having the same are provided. An oil separator is installed either outside or inside of a casing to separate oil from a discharged refrigerant and an oil pump driven by a driving force of a motor is used to recollect the oil separated in the oil separator, whereby the separation between oil and refrigerant can effectively be performed and also a fabricating cost can be reduced. Also, an introduction of the separated refrigerant back into the compressor can be prevented so as to improve a cooling capability of the refrigeration cycle device. In addition, the oil pump is driven by the driving force of the motor, resulting in a simple configuration of the compressor and a reduction of a fabricating cost of the compressor.

21 Claims, 17 Drawing Sheets

FOREIGN PATENT DOCUMENTS

| | | | | | |
|---|---|---|---|---|---|
| JP | 5-223074 | A | | 8/1993 | |
| JP | 05248374 | A | * | 9/1993 | |
| JP | 2003-139059 | A | | 5/2003 | |
| JP | 2005-240637 | A | | 9/2005 | |
| KR | 100688656 | B1 | * | 2/2007 | ..... 418/88 |
| KR | 20070056517 | A | * | 6/2007 | ..... 418/88 |

* cited by examiner

HERMETIC COMPRESSOR AND REFRIGERATION CYCLE DEVICE HAVING THE SAME

CROSS-REFERENCE TO RELATED APPLICATIONS

The present application claims priority to Korean Application No. 10-2007-0076579, filed on Jul. 30, 2007, Korean Application No. 10-2007-0139286, filed on Dec. 27, 2007, and Korean Application No. 10-2008-0070335, filed on Jul. 18, 2008, which are herein expressly incorporated by reference in their entireties.

BACKGROUND OF THE INVENTION

1. Field of the Invention

The present invention relates to a compressor and refrigeration cycle device having the same, and, more particularly, to an oil recollecting apparatus of a compressor capable of separating and recollecting oil from a refrigerant discharged from a compressing unit of the compressor.

2. Description of Related Art

A compressor is a device for converting kinetic energy into compression energy of a compressive fluid. A hermetic compressor is configured such that a motor for generating a driving force and a compression unit for compressing fluid by the driving force received from the motor are all installed in an inner space of a hermetically sealed container.

When the hermetic compressor is provided as a component in a refrigerant compression refrigeration cycle device, a certain amount of oil is stored in the hermetic compressor in order to cool the motor of the compressor or smooth and seal the compression unit. However, when die compressor is driven, the refrigerant discharged from the compressor into the refrigeration cycle device includes oil mixed in with the refrigerant. Part of the oil discharged into the refrigeration cycle device is not recollected to the compressor but remains in the refrigeration cycle device, thereby causing a decrease in the amount of oil in the compressor. This may result in decrease in compressor reliability and also degradation of heat-exchange capability of the refrigeration cycle device due to the oil remaining in the refrigeration cycle device.

Accordingly, in the related art, an oil separator is disposed at a discharge side of the compressor to separate oil from the discharged refrigerant, and such separated oil is recollected to a suction side of the compressor, thereby avoiding the lack of oil in the compressor and also maintaining the heat-exchange capability of the refrigeration cycle device.

However, when recollecting oil separated by the oil separator into the suction side of the compressor, the high pressure refrigerator is also recollected together with the oil, which results in decreasing the amount of refrigerant circulating in the refrigeration cycle device, thereby lowering a cooling capability of the compressor. In addition, temperature of suction gas in the compressor is increased to thereby raise temperature of discharge gas. Accordingly, the reliability of the compressor is degraded. Also, as the temperature increases, a specific volume of the sucked refrigerant is increased, so as to decrease the actual amount of the sucked refrigerant, thereby degrading the cooling capability of the compressor.

In an attempt to decrease pressure and temperature of oil recollected from the oil separator into the compressor, to decrease pressure and temperature of oil removed from the refrigerant, and to prevent the backflow of the refrigerant into the compressor, a decompressing device, such as a capillary tube, the related art may include a decompressing device, such as a capillary tube, is provided between the oil separator and the suction side of the compressor. However, even if the decompressing device is so located, the pressure of the oil separator is higher than the pressure of the suction side of the compressor, which causes an increase in suction temperature and suction pressure of the compressor. In particular, when driving the compressor at low speed, the amount of oil pumped is decreased in the compressor. As a result, more refrigerant is recollected than oil, thereby further degrading the cooling capabilities of the compressor and the refrigeration cycle device.

Furthermore, as the oil, which has been separated by the oil separator and then recollected, is mixed with the sucked refrigerant, it is discharged with the refrigerant via the compressing unit, thereby leaving insufficient oil in the inner space of the casing causing the reliability of the compressor to deteriorate further.

BRIEF SUMMARY OF THE INVENTION

Therefore, in order to solve those problems of the related art compressor, an object of the present invention is to provide a compressor having an oil recollecting apparatus for recollecting oil separated from a refrigerant discharged from a compressing unit, and to provide a refrigeration cycle device having the same.

To achieve these and other advantages and in accordance with the purpose of the present invention, as embodied and broadly described herein, there is provided a compressor including a casing having an inner space, a suction pipe connected to the casing, a discharge pipe connected to the casing, a motor located in the inner space of the casing to generate a driving force, the motor having a crankshaft, a compressing unit located in the inner space of the casing, the compressing unit being driven by the motor to compress a refrigerant, an oil separator configured to separate oil from a refrigerant discharged from the compressing unit, and at least one oil pump configured to pump oil separated from the oil separator for recollection. The oil pump is coupled to the crankshaft of the motor to be driven by a rotational force of the crankshaft.

According to a different aspect of the present invention, there is provided a compressor having a casing having an inner space, a suction pipe connected to the casing, a discharge pipe connected to the casing, a motor located in the inner space of the casing, the motor including a rotor, a crankshaft coupled to the rotor of the motor to rotate therewith, the crankshaft including an oil passage formed therethrough, a compressing unit located in the inner space of the casing and coupled the crankshaft to compress a refrigerant, an oil separator configured to separate oil from a refrigerant discharged from the compressing unit, and at least one oil pump installed inside the casing to pump oil. The at least one oil pump includes a first inlet to allow oil discharged from the compressing unit to be pumped, and a second inlet in communication with the inner space of the casing to allow oil contained in the inner space of the casing to be pumped.

According to yet another aspect of the present invention, there is provided a refrigeration cycle device having a compressor having a suction side and a discharge side, a condenser connected to the discharge side of the compressor, an oil separator located between the compressor and the condenser to separate oil from a refrigerant, an expander connected to the condenser, and an evaporator connected between the expander and the suction side of the compressor. The compressor includes a casing having an inner space, a motor located in the inner space of the casing, a crankshaft coupled to motor to be rotated by the motor, and a compressing unit located in the inner space of the casing and driven by the motor to compress a refrigerant. At least one oil pump is located in the inner space of the casing of the compressor and is coupled to the crankshaft of the motor so as to pump oil separated in the oil separator and simultaneously pump oil contained in the inner space of the casing.

Further scope of applicability of the present application will become more apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Description will now be given in detail of a compressor and a refrigeration cycle device having the same according to the present invention, with reference to the accompanying drawings. Although the description of the present invention is given with reference to hermetic scroll compressors, the present invention is not limited to scroll compressors, but can be equally applied to other so-called hermetic compressors, such as rotary compressors, having a motor and a compressing unit disposed in the same casing.

Figure 1:
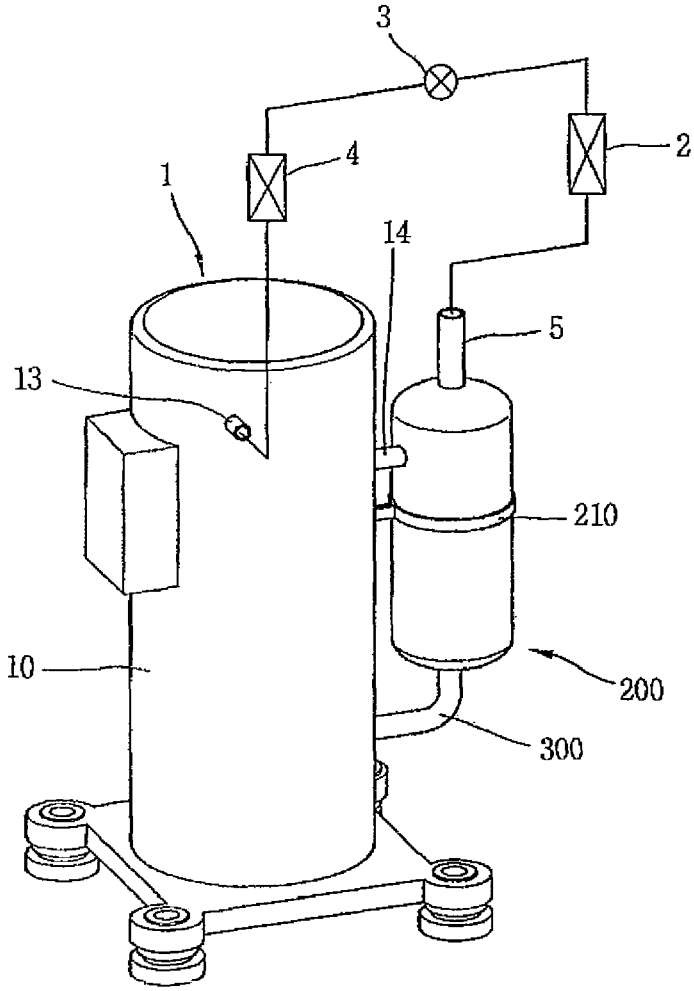
FIG. 1 is a perspective view showing a hermetic compressor in a refrigeration cycle device according to an exemplary embodiment of the present invention.
Figure 2:
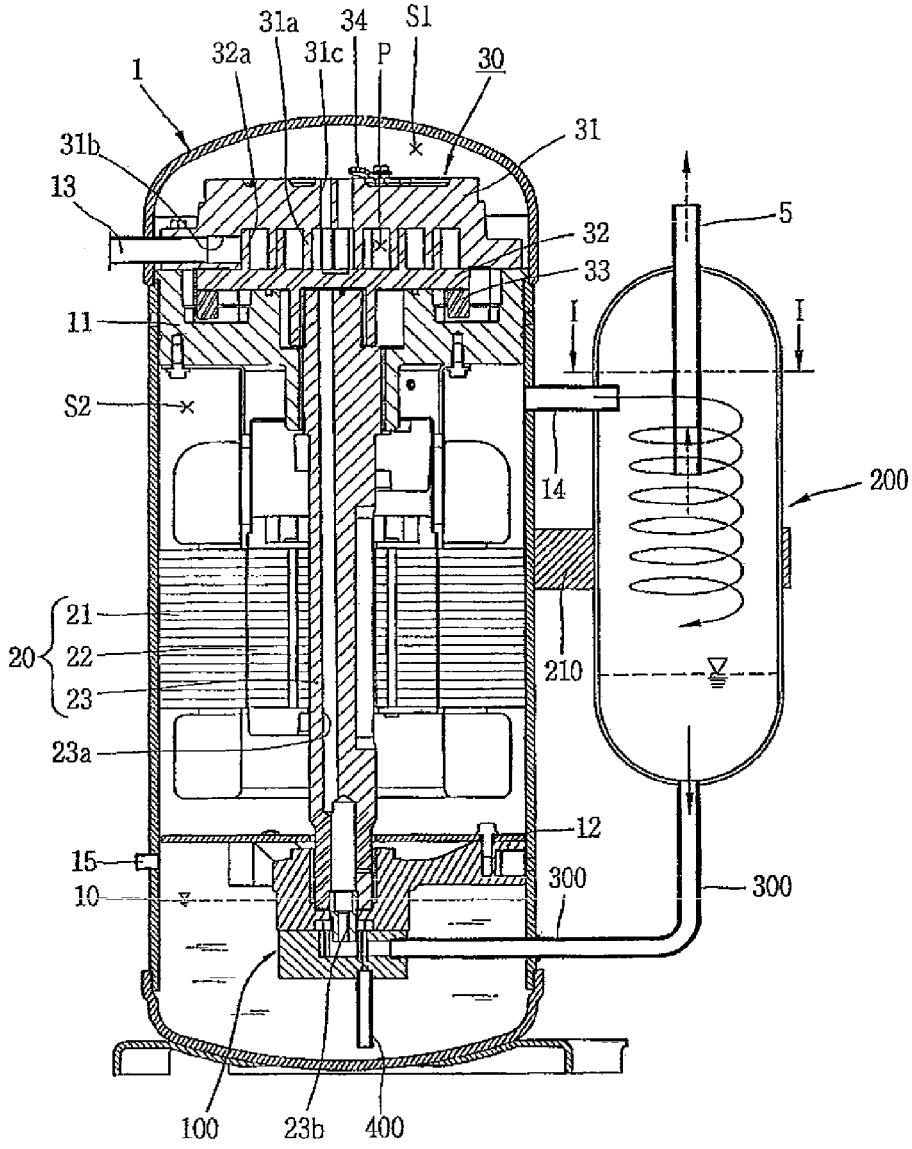
FIG. 2 is a longitudinal sectional view showing one exemplary embodiment of the hermetic compressor of FIG. 1.

FIG. 1 is a perspective view showing the outside of a scroll compressor, as one example of a compressor according to the present invention, and FIG. 2 is a longitudinal sectional view showing an inside thereof.

As shown in FIGS. 1 and 2, a scroll compressor 1 according to the present invention may include a compressor casing (hereinafter, referred to as 'casing') 10 having a hermetic inner space, a motor 20 located in the inner space of the casing 10 to generate a driving force, and a compressing unit 30 driven by the motor 20. The compressing unit includes a fixed scroll 31 and an orbiting scroll 32 for compressing a refrigerant.

A main frame 11 and a sub-frame 12 are provided inside the casing 10 to support not only a crankshaft 23 of the motor 20 but also the compressing unit 30. The main frame 11 and the sub-frame are fixedly located at opposite sides of the motor 20 in the inner space of the casing 10. A suction pipe 13 and a discharge pipe 14 are connected to the casing 10 such that the compressor 1 can provide a refrigeration cycle device in cooperation with a condenser 2, an expander 3, and an evaporator 4. The suction pipe 13 is connected to the evaporator 4 of the refrigeration cycle device while the discharge pipe 14 is connected to the condenser 2 of the refrigeration cycle device. The suction pipe 13 is connected directly to a suction side of the compressing unit 30 and a discharge side of the compressing unit 30 is in communication with the inner space of the casing 10 such that the inner space of the casing 10 can be filled with a refrigerant at a discharge pressure. An oil separating unit 200 is provide at an end of the discharge pipe 14 for separating oil from a refrigerant discharged from the compressor 1 to the condenser 2 via the discharge pipe 14. In particular, the oil separating unit 200 is located between the discharge side of the compressor 1 and an inlet of the condenser 2.

The motor 20 may be a constant speed motor rotating at a uniform speed, or an inverter motor rotating at variable speed depending on the needs of a refrigerating device to which the compressor 1 is applied. The motor 20 may include a stator 21 fixed to an inner circumferential surface of the casing 10, a rotor 22 rotatably disposed at an inside of the stator 21, and a crankshaft 23 coupled to the center of the rotor 22 to transfer a rotation force of the motor 20 to the compressing unit 30. The crankshaft 23 is supported by the main frame 11 and the sub-frame 12. An oil passage 23*a* extends in an axial direction through the crankshaft 23. An oil pump 100, which will be described later, is located at a lower end of the oil passage 23*a*, in particular, at a lower end of the crankshaft 23. Accordingly, the oil pump 100 is configured to pump oil toward the oil passage 23*a*.

The compressing unit 30, as shown in FIG. 2, includes a fixed scroll 31 coupled to the main frame 11, an orbiting scroll 32 engaged with the fixed scroll 31 to configure a pair of compression chambers P which continuously move, an Oldham ring 33 disposed between the orbiting scroll 32 and the main frame 11 to induce the orbiting motion of the orbiting scroll 32, and a check valve disposed to open/close a discharge opening 31*c* of the fixed scroll 31 so as to block a backflow of discharge gas discharged through the discharge opening 31*c*. A fixed wrap 31*a* and an orbiting wrap 32*a* are spirally formed respectively at the fixed scroll 31 and the orbiting scroll 32. The fixed wrap 31*a* and the orbiting wrap 32*a* are engaged with each other to form the compression chambers P. The suction pipe 13 for guiding a refrigerant from the refrigeration cycle device is directly connected to a suction opening 31*b* of the fixed scroll 31, and the discharge opening 31*c* of the fixed scroll 31 is communicated with the inner space of the casing 10.

An oil supplying hole 15 for injecting oil into the inner space of the casing 10 may be formed at a lower portion of the casing 10. When a plurality of compressors are used, the oil supplying hole 15 may be used as an oil equalizing hole to place the plurality of compressors in communication with each other in order to match liquid-level heights of each of the compressors.

Operation of the compressor will be described with reference to the above configuration. When power is applied to the motor 20, the crankshaft 23 rotates together with the rotor 22 to forward such rotational force to the orbiting scroll 32. The orbiting scroll 32 receiving the rotational force applied is then orbited by the Oldham ring 33 on an upper surface of the main frame 11, thereby forming a pair of compression chambers P which are continuously moved between the fixed wrap 31*a* of the fixed scroll 31 and the orbiting wrap 32*a* of the orbiting scroll 32. Such compression chambers P are then moved to the center by the continuous orbiting motion of the orbiting scroll 32 such that their capacities decrease to thereby compress a sucked refrigerant. The compressed refrigerant is continuously discharged up to an upper space S1 of the casing 10 through the discharge opening 31*c* of the fixed scroll 31 and then moved down to a lower space S2 of the casing 10, thereby being discharged into the condenser 2 of the refrigeration cycle device through the discharge pipe 14. The compressed refrigerant may be moved from upper space S1 to lower space S2 using various approaches, such as, for example providing a passage (not shown) through the fixed scroll 31 and/or main frame 11. The compressed refrigerant discharged to the condenser 2 of the refrigeration cycle device then flows through the expander 3 and then the evaporator 4 to be sucked into the compressor 1 via the suction pipe 13. This process may be continuously repeated as the crankshaft 23 rotates.

In this exemplary embodiment the oil pump 100 is driven in cooperation with the crankshaft 23 so as to pump oil contained in the inner space of the casing 10 or oil separated from the refrigerant discharged from the compressing unit 30. Such pumped oil is sucked up through the oil passage 23*a* of the crankshaft 23 and used for lubricating the compressing unit 30 and also cooling the motor 20. This process will be described in greater detail below.

The oil separator 200 is located outside the casing 10. One end of an oil recollecting pipe 300 is connected to a lower end of the oil separator 200 and another end of the oil recollecting pipe 300 penetrates through the casing 10 to be connected to the oil pump 100. The oil recollecting pipe 300 guides oil separated in the oil separator 200 to the oil pump 100.

The oil separator 200, as shown in FIGS. 1 and 2, may have a cylindrical shape and defines a hermetic inner space. As shown, the oil separator 200 is disposed in parallel with one side of the casing 10. The oil separator 200 is connected to the oil recollecting pipe 300, and may be supported by the casing 10 directly or may be supported by a separate supporting member 210, as shown, which fixes the oil separator 200 to the casing 10.

As shown in FIG. 2, the discharge pipe 14 penetrates through, and is connected to, an upper side wall surface of the oil separator 200 to cause a refrigerant discharged from the inner space of the casing 10 to flow into the inner space of the oil separator 200. A refrigerant pipe 5 penetrates through, and is connected to, an upper end of the oil separator 200 such that a refrigerant separated from oil in the inner space of the oil separator 200 can flow toward the condenser 2 of the refrigeration cycle device. An oil recollecting pipe 300 is inserted into a lower end of the oil separator 200 to a certain depth such that oil separated in the inner space of the oil separator 200 can be recollected into the casing 10 or the compressing unit 30. The oil recollecting pipe 300 may be a metallic pipe having a suitable strength to stably support the oil separator 200. Also, the oil recollecting pipe 300 may be curved through an angle so that the oil separator 200 is parallel with the casing 10, thereby reducing a vibration of the compressor.

The oil separating unit 200 may use various methods for separating oil. For example, a mesh screen may be installed inside the oil separator 200 to thereby separate oil from a refrigerant, or the discharge pipe 14 may be connected to an axial center of the oil separator 200 at an incline such that a refrigerant rotates in a form of cyclone to thereby separate relatively heavy oil from the refrigerant.

Figure 4:
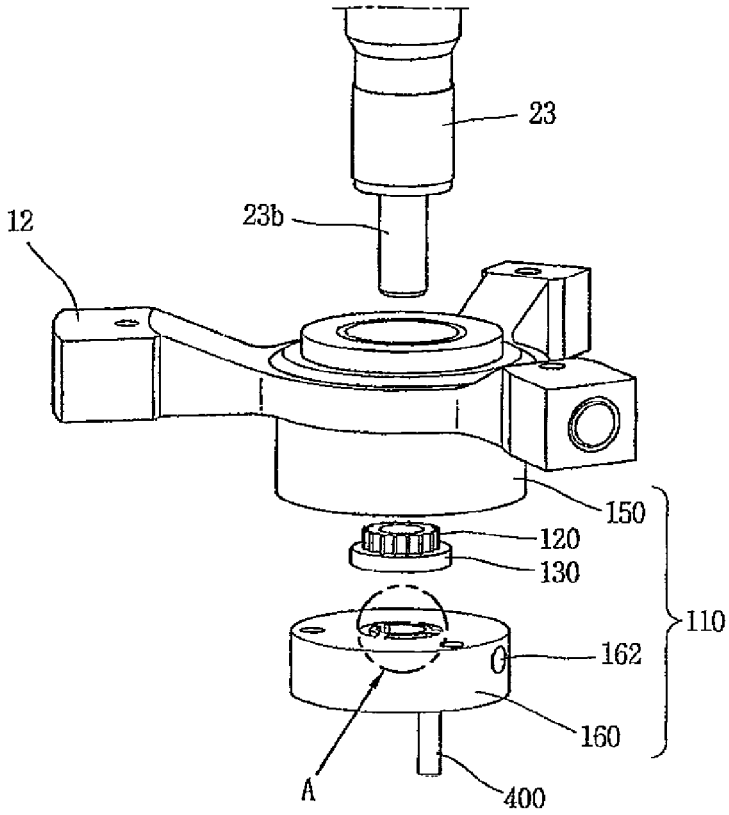
FIG. 4 is an exploded view of the oil pump of the hermetic compressor of FIG. 2.
Figure 4A:
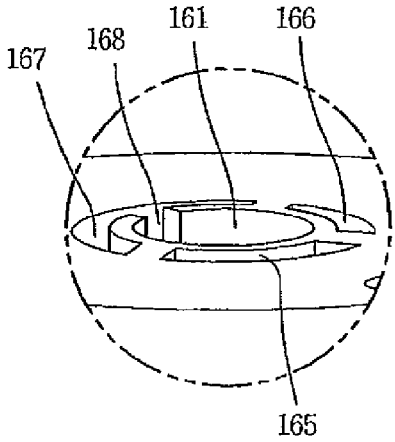
FIG. 4A is a detailed view of the oil pump designated by call-out A of FIG. 4.
Figure 5:
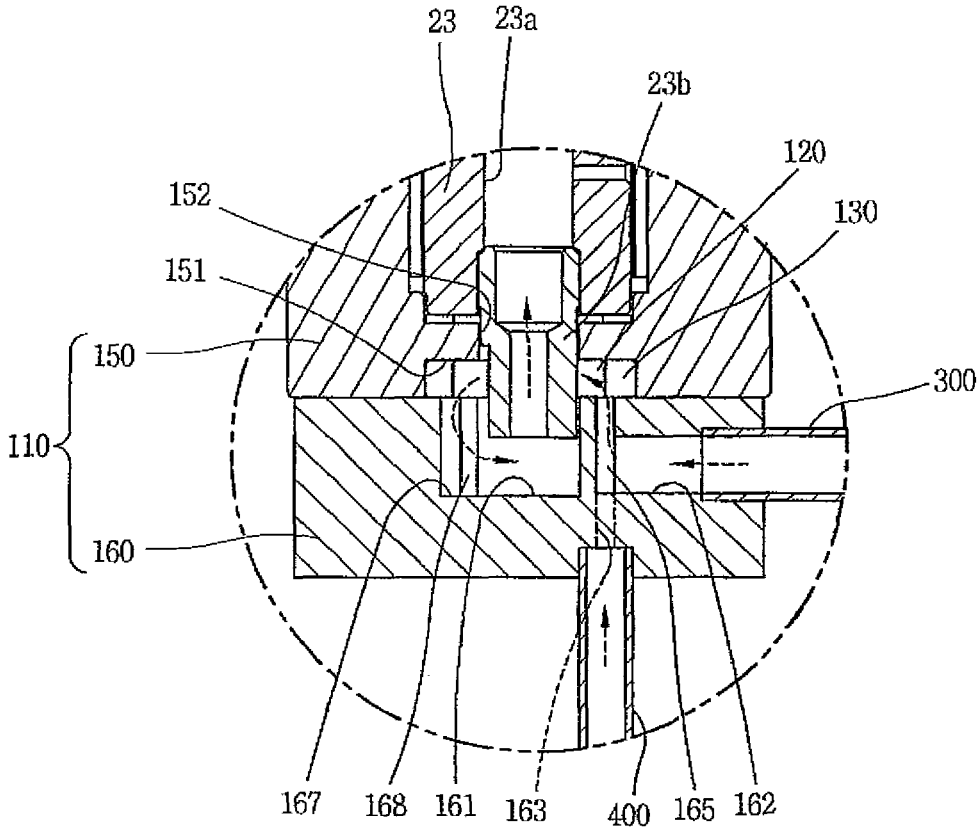
FIG. 5 is a longitudinal view showing an assembled state of the oil pump of the hermetic compressor of FIG. 2.

The oil pump 100 may be a volumetric pump, such as a trochoid gear pump, for pumping oil as its volume (capacity) is varied. For example, as shown in FIGS. 4 and 5, the oil pump 100 may include a pump housing 110 coupled to the sub-frame 12 supporting the crankshaft 23 and having a pumping space 151 formed therein, an inner gear 120 rotatably located in the pumping space 151 of the pump housing 110 and coupled to the crankshaft 23 to be eccentrically rotated, and an outer gear 130 rotatably located in the pumping space 151 to provide a variable volume (capacity) by engagement with the inner gear 120.

The pump housing 110 includes an upper housing 150 coupled to the sub-frame 12 and a lower housing 160 coupled to a lower end of the upper housing 150. The pumping space 151 is formed between the upper housing 150 and the lower housing 160. A through hole 152 is formed through a bottom surface of the upper housing 150 such that a pin portion 23*b* of the crankshaft 23 can be inserted therethrough. The lower housing 160 has a first inlet 162 and a second inlet 163. The first inlet 162 is formed in a radial direction to be in communication with the oil recollecting pipe 300 and the second inlet 163 is formed in an axial direction to be in communication with an oil suction pipe 400. The oil suction pipe 400 has an inlet with a suitable length so as to extend into the oil contained at the bottom of the casing 10.

The lower housing 160 will be described with reference to FIGS. 6 and 7. A communicating groove 161 is formed in a central portion of an upper surface of the lower housing 160 such that the oil passage 23*a* of the crankshaft 23 can communicate therewith. A first suction guiding groove 165 in communication with the first inlet 162 is formed around one side of the communicating groove 161. The first inlet 162 is formed in an upper surface of the lower housing 160 contacted with a lower surface of the inner gear 120 and outer gear 130. A second suction guiding groove 166 in communication with the second inlet 163 is formed in the same upper surface as the first suction guiding groove 165, but is displace in a circumferential direction from the first suction guiding groove 165. A discharge guiding groove 167 is formed at a side opposite to the first and second suction guiding grooves 165 and 166. In this exemplary embodiment, the first inlet 162 and the second inlet 163 can be formed to communicate with each other. However, when a pressure difference occurs between the first inlet 162 and the second inlet 163, a backflow of oil may occur; therefore, it is preferable that the first inlet 162 and the second inlet 163 are provided with a certain interval therebetween.

The first and second suction guiding grooves 165 and 166 may each be formed in an arcuate shape having an approximately 90° arc angle. The first and second suction guiding groove 165 and 166 are divided by a partition wall. The discharge guiding groove 167 may be formed in an arcuate shape having an approximately 180° arc angle. A discharge slot 168 is formed at an inner side wall of the discharge guiding groove 167 and is in communication with the communicating groove 161.

Figure 6:
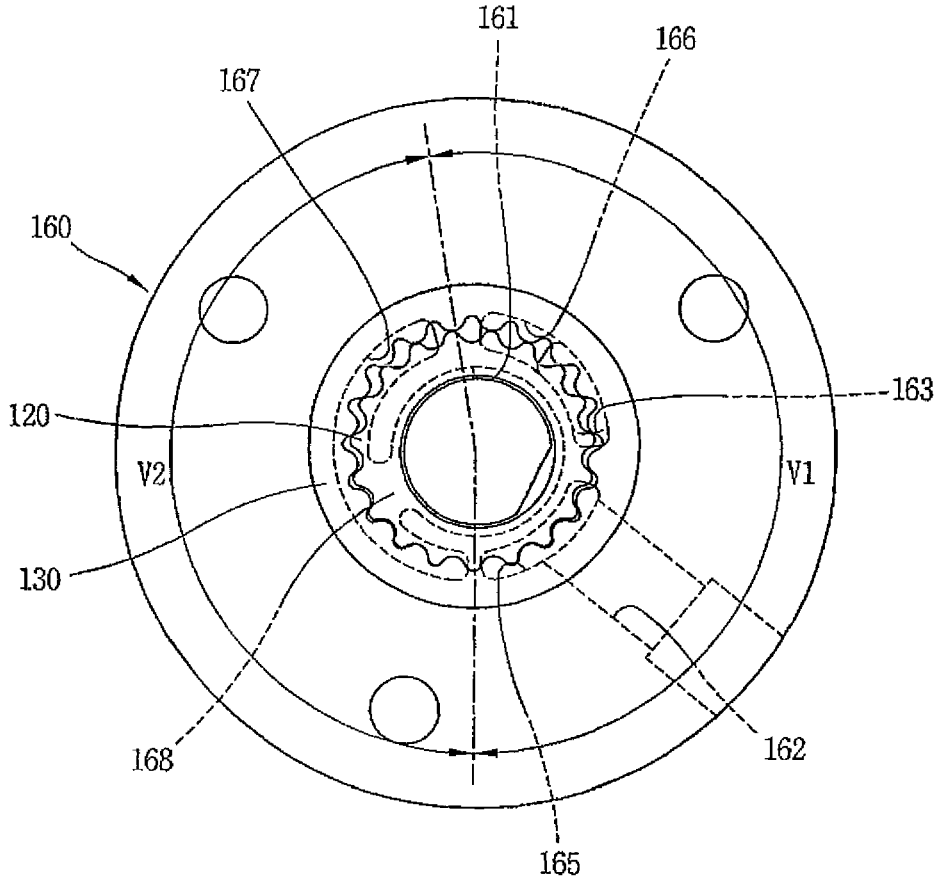
FIG. 6 is a plane view showing a lower housing including inner gear and outer gear in the oil pump of FIG. 5.
Figure 7:
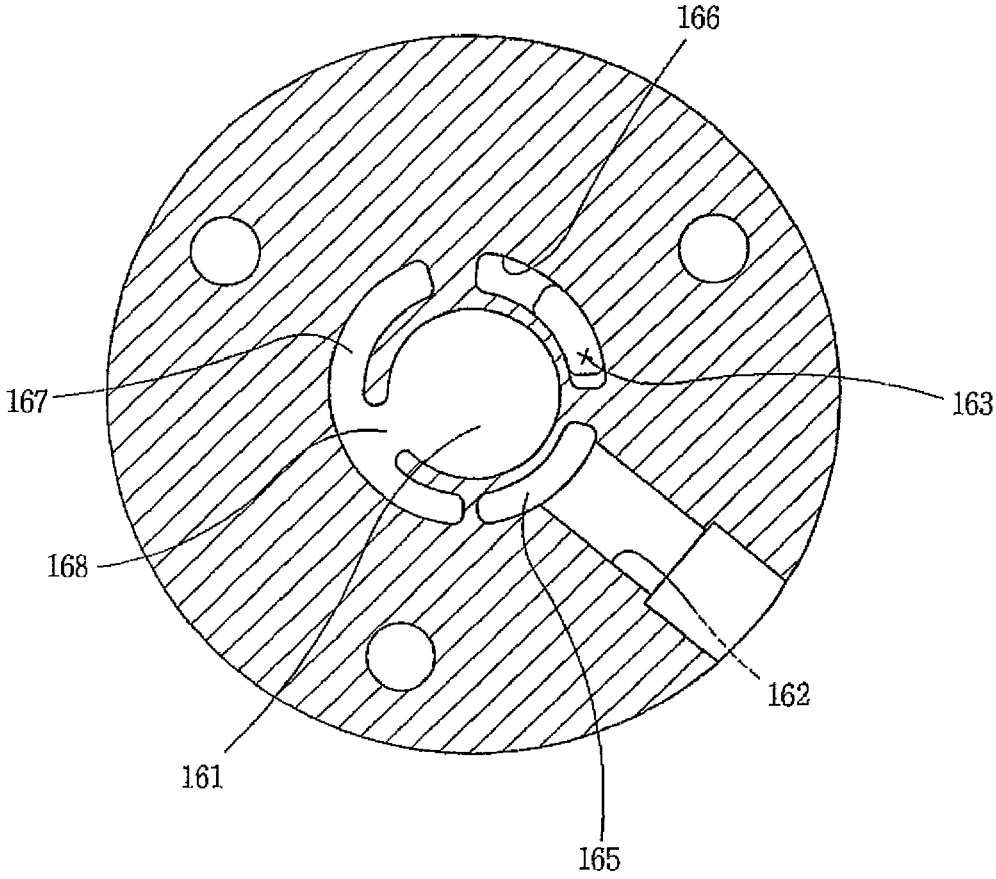
FIG. 7 is a plane view showing a top face of the lower housing having the inner gear and outer gear removed therefrom in the oil pump of FIG. 6.

As shown in FIG. 6, a suction capacity portion V1 is formed such that its capacity gradually increases in a rotational direction of the inner gear 120 from a start portion of the first suction guiding groove 165 in its circumferential direction to an end portion of the second suction guiding groove 166, while the discharge capacity portion V2 follows the suction capacity portion V1 and is formed such that its capacity gradually decreases in the rotational direction of the inner gear 120 from start to end portions of the discharge guiding groove 167. In this manner, the variable capacity of the oil pump 100 is provided by the interaction of the inner gear 120 and the outer gear 130.

Figure 8:
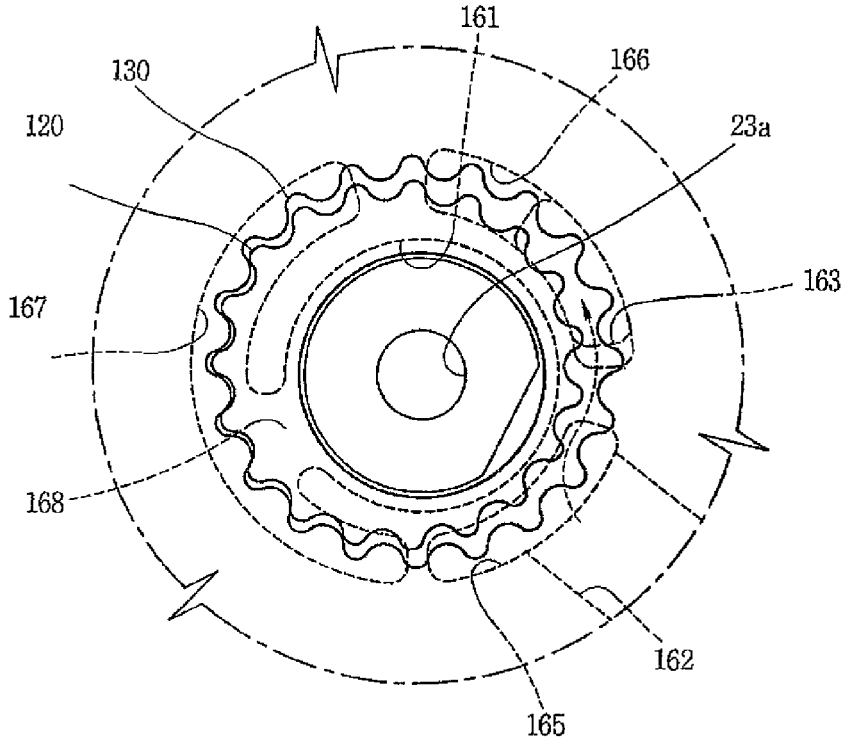
FIGS. 8 to 10 are plane views schematically showing a process of pumping oil at the oil pump of FIG. 5.
Figure 9:
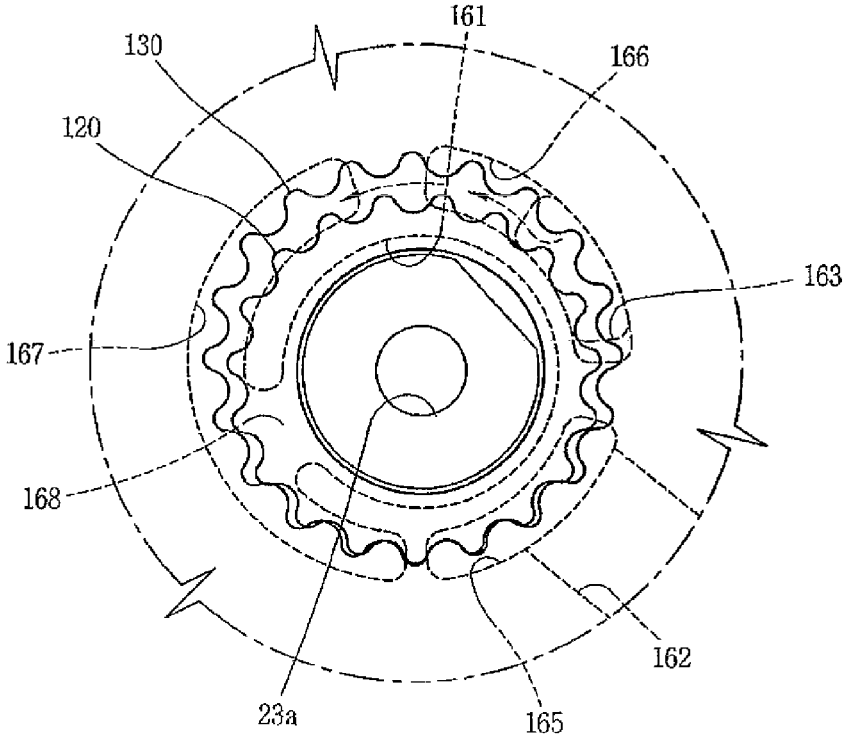

Operation of the oil pump 100 of the compressor 1 will now be described with reference to FIGS. 8 to 10. In particular, the operation of the oil pump 100 to recollect oil contained in the casing 10 and oil separated from a refrigerant and then to supply the recollected oil back into the compressing unit 30, will be described.

The inner gear 120 of the oil pump 100 is coupled to the crankshaft 23 to be eccentrically rotated by the crankshaft 23, thereby forming the suction capacity portion V1 and the discharge capacity portion V2 between the inner gear 120 and the outer gear 130. In the suction capacity portion V1, as the first inlet 162 is in communication with the second inlet 163, as shown in FIG. 8, oil separated in the oil separator 200 passes through the oil recollecting pipe 300 to be introduced into the first suction guiding groove 165 via the first inlet 162. Oil contained in a bottom of the casing 10 is sucked up via the oil suction pipe 400 to be introduced into the second suction guiding groove 166 via the second inlet 163, as shown in FIG. 9. The oil introduced into the first suction guiding groove 165 is collected in the suction capacity portion V1 to be introduced into the second suction guiding groove 166 over a partition wall therebetween, and the oil introduced into the second guiding groove 166 flows toward the discharge capacity portion V2 from the suction capacity portion V1.

Figure 10:
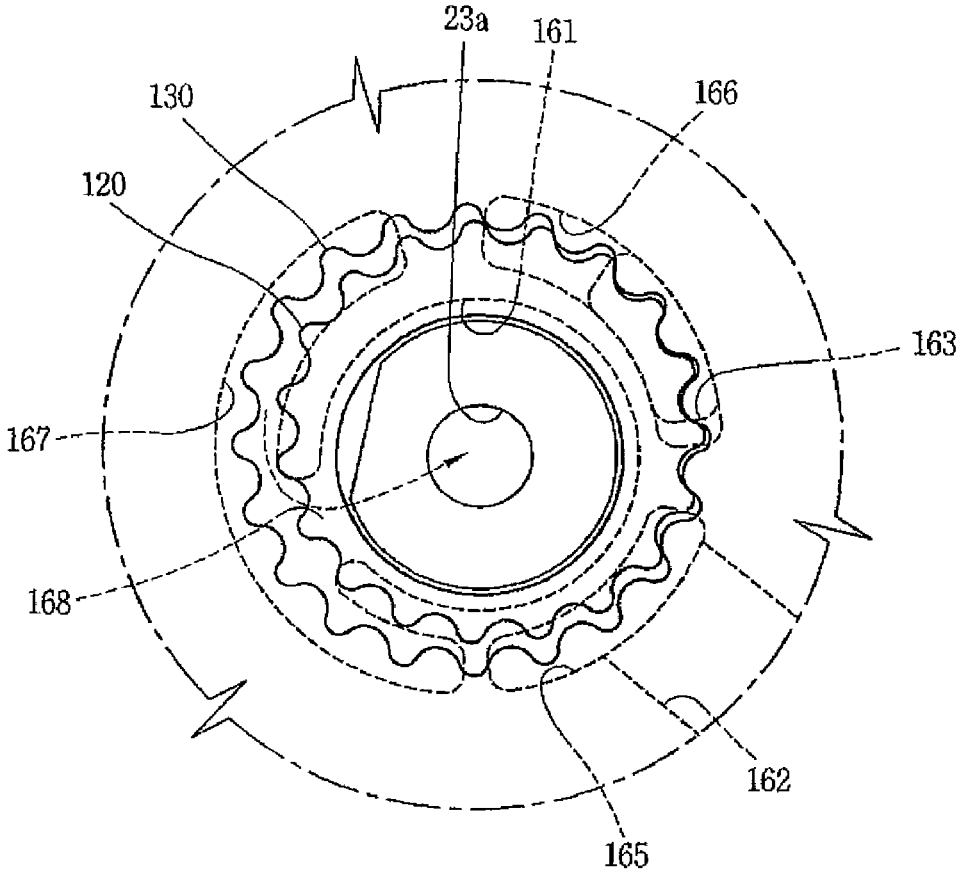

The oil then flows into the discharge capacity portion V2, as shown in FIG. 10, and is introduced into the discharge guiding groove 167, to thereafter be introduced into the communicating grove 161 via the discharge slot 168 disposed at the inner circumferential surface of the discharge guiding groove 167. The oil introduced into the communicating groove 161 is sucked into the oil passage 23*a* of the crankshaft 23 and is moved up through the oil passage 23*a* by a centrifugal force of the oil passage 23*a*. A portion of the sucked oil can be supplied to bearing surfaces and, at the same time, the remaining oil is dispersed at an upper end of the oil passage 23*a* to be introduced into the compressing unit 30. This process may be continuously repeated as the crankshaft 23 is rotated.

In this exemplary embodiment, once the oil separated from the oil separator 200 is recollected into the oil pump 100 via the oil recollecting pipe 300, the recollected oil is supplied directly to each bearing surface and the compressing unit 30. However, foreign materials, such as welding slag, which is generated upon assembling the compressor, may be contained in oil recollected via the oil recollecting pipe 300 and the foreign materials should be filtered to prevent an abrasion of each bearing surface and the compressing unit 30. Therefore, a foreign material filter (not shown) for filtering foreign materials contained in oil may be installed in an intermediate portion of the oil recollecting pipe 300.

According to the above process, oil separated in the oil separator 200 is forcibly recollected by the oil pump such that an amount of oil recollected is greatly increased. Therefore, a heat-exchange capability of the refrigeration cycle device is enhanced, thereby remarkably improving a cooling capability of the refrigeration cycle device. In addition, the forcibly recollected oil is introduced directly into the oil passage 23*a* of the crankshaft 23 without passing through the inner space of the casing 10. As a result, it is possible to prevent such oil from flowing out again with being re-mixed with a sucked refrigerant prior to passing through the compression unit 30. Furthermore, since the recollected oil is separated from the sucked refrigerant, thereby preventing the re-expansion of the sucked refrigerant in the compressor 1, the capability and reliability of the compressor 1 can be enhanced and also the cooling capability of the refrigeration cycle device can be improved.

Because a single oil pump 100 is used to recollect oil and to pump oil contained in the casing, a simplified configuration of the oil pump is possible, thereby reducing a fabricating cost of the compressor. In addition, because the oil pump 100 is driven by using the driving force of the motor 20, the configuration of the compressor 1 is simplified, thereby further reducing the fabricating cost of the compressor.

Figure 11:
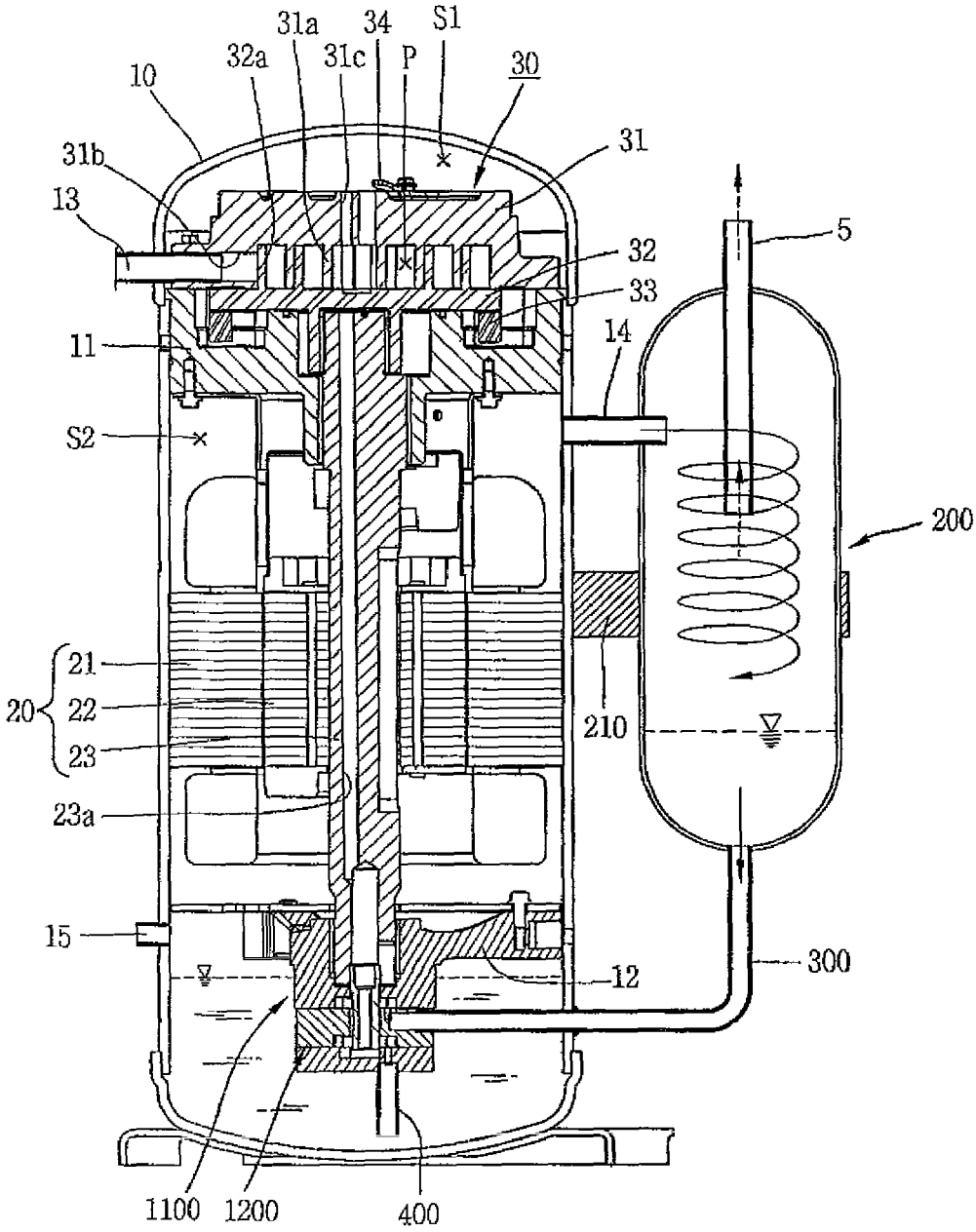
FIG. 11 is a longitudinal view showing another exemplary embodiment of the hermetic compressor of FIG. 1.

While the first exemplary embodiment of the compressor includes a single oil pump used not only to recollect oil separated in the oil separator but also to pump oil contained in the inner space of the casing 10, another exemplary embodiment of the compressor, as shown in FIG. 11, includes a plurality of oil pumps. Specifically, the compressor according to this exemplary embodiment includes a first oil pump 1100 for recollecting oil and a second oil pump 1200 for pumping oil contained in the inner space of the casing 10.

Figure 12:
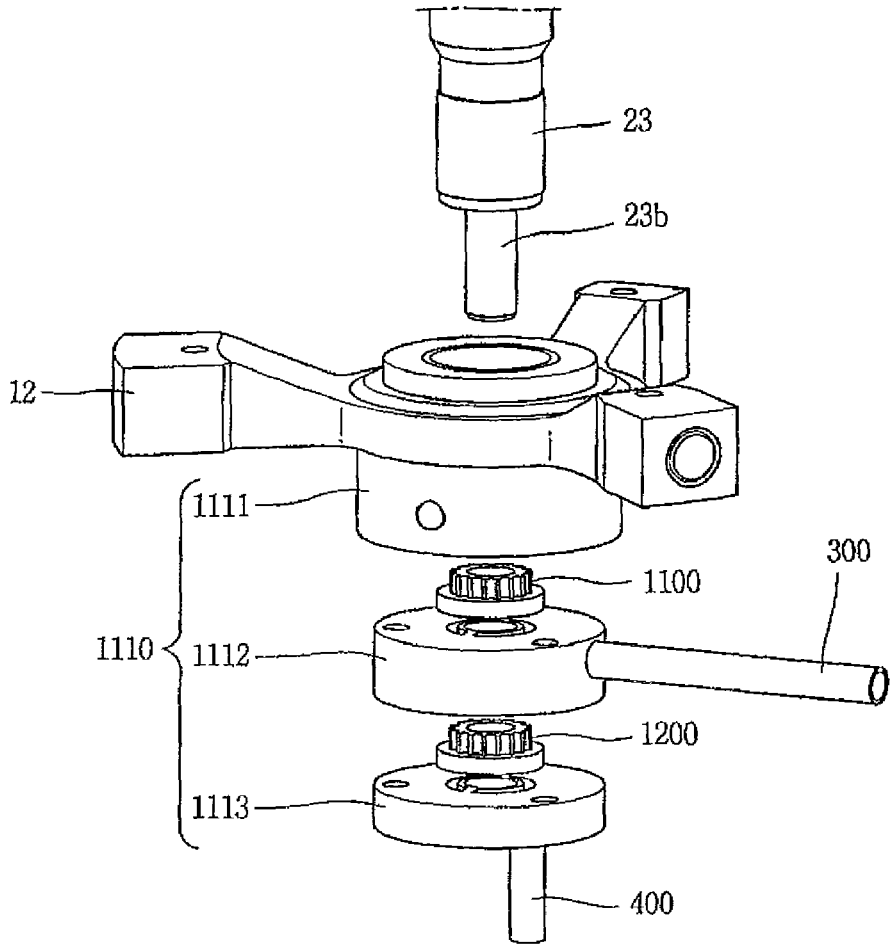
FIG. 12 is an exploded view of the oil pumps of FIG. 11.
Figure 13:
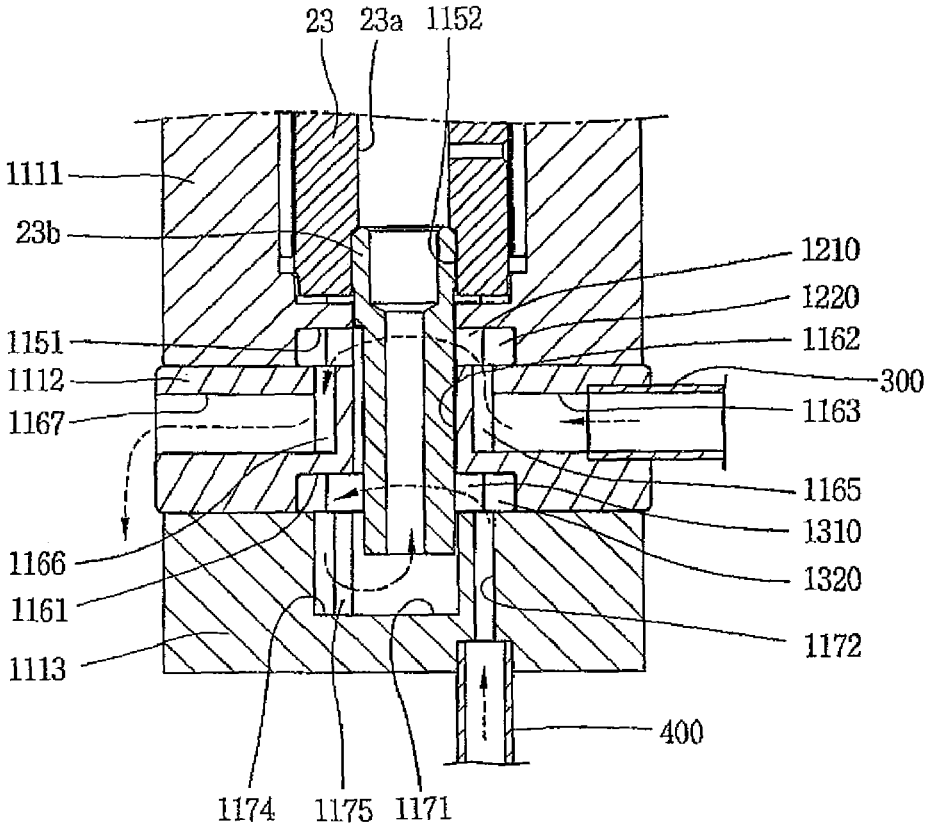
FIG. 13 is a longitudinal sectional view showing an assembled state of the oil pumps of the hermetic compressor of FIG. 11.

Similar to the oil pump 100 in the aforementioned embodiment, the first and second oil pumps 1100 and 1200 can be trochoid gear pumps having first and second variable capacities. In this exemplary embodiment, the first and second oil pumps 1100 and 1200 may be disposed at upper and lower sides in an axial direction of the crankshaft 23. As shown in FIGS. 12 and 13, the first oil pump 1100 includes a pump housing 1110 having a first pumping space 1151, a first inner gear 1210 inserted into the first pumping space 1151 of the pump housing 1110 and coupled to the crankshaft 23 to be eccentrically rotated, and a first outer gear 1220 engaged with the first inner gear 1210 to form a first variable capacity of the oil pump 1100.

The second oil pump 1200 includes a second pumping space 1161 in the pump housing 1110, a second inner gear 1310 inserted into the second pumping space 1161 of the pump housing 1110 and coupled to the crankshaft 23 to be eccentrically rotated, and a second outer gear 1320 engaged with the second inner gear 1310 to form a second variable capacity.

The pump housing 1110 includes an upper housing 1111 coupled to the sub-frame 12, an intermediate housing 1112 disposed at a lower surface of the upper housing 1111, and a lower housing 1113 disposed at a lower surface of the intermediate housing 1112 and coupled to the upper housing 1111 together with the intermediate housing 1112.

The first pumping space 1151 is formed in the lower surface of the upper housing 1111 such that the first inner gear 1210 and the first outer gear 1220 are inserted therein. A first pin hole 1152 is formed through the center of the first pumping space 1151 such that the pin portion 23*b* of the crankshaft 23 can penetrate therethrough.

The second pumping space 1161 is formed in the lower surface of the intermediate housing 1112 such that the second inner gear 1310 and the second outer gear 1320 are inserted therein. A second pin hole 1162 is formed through the center of the second pumping space 1161 such that the pin portion 23*b* of the crankshaft 23 can penetrate therethrough.

Figure 14:
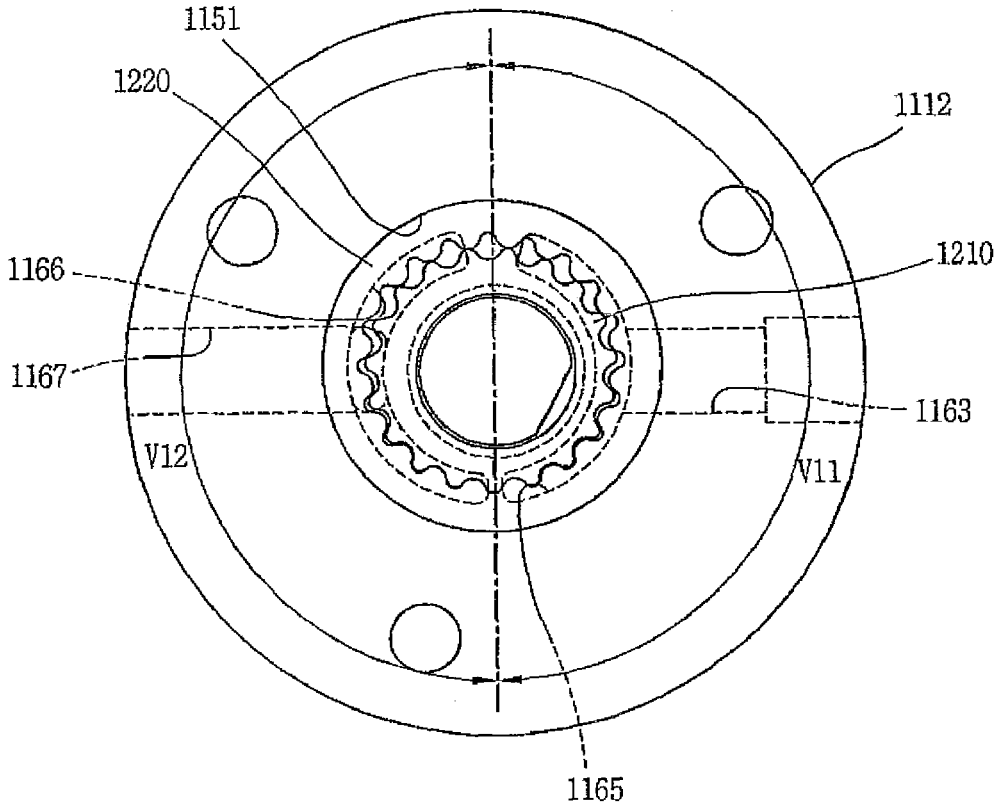
FIG. 14 is a plane view showing a first oil pump of the oil pumps of FIG. 13.

As shown in FIGS. 13 and 14, a first inlet 1163 is formed in a radial direction of the intermediate housing 1112 and is in communication with the oil recollecting pipe 300. A first suction guiding groove 1165 is provided in the intermediate housing 1112 to allow the first inlet 1163 to be in communication with a first suction capacity portion V11. The first suction capacity portion V11 is configured between the first inner gear 1210 and the first outer gear 1220 similar to the suction capacity portion V1 described above. The first suction guiding groove 1165 is formed in a semi-circular arcuate shape.

A first discharge guiding groove 1166 is in communication with a first discharge capacity portion V12. The first discharge capacity portion V12 is configured between the first inner gear 1210 and the first outer gear 1220 similar to the discharge capacity portion V2 described above. The first discharge guiding groove 1166 is formed at a side opposite to the first suction guiding groove 1165. A first discharge slot 1167 for guiding oil in the first discharge guiding groove 1166 into the inner space of the casing 10 is formed at an outer side wall surface of the first discharge guiding groove 1166 so as to be in communication with the inner space of the casing 10. The first discharge slot 1167 may be formed as a hole-like shape, for example.

Figure 15:
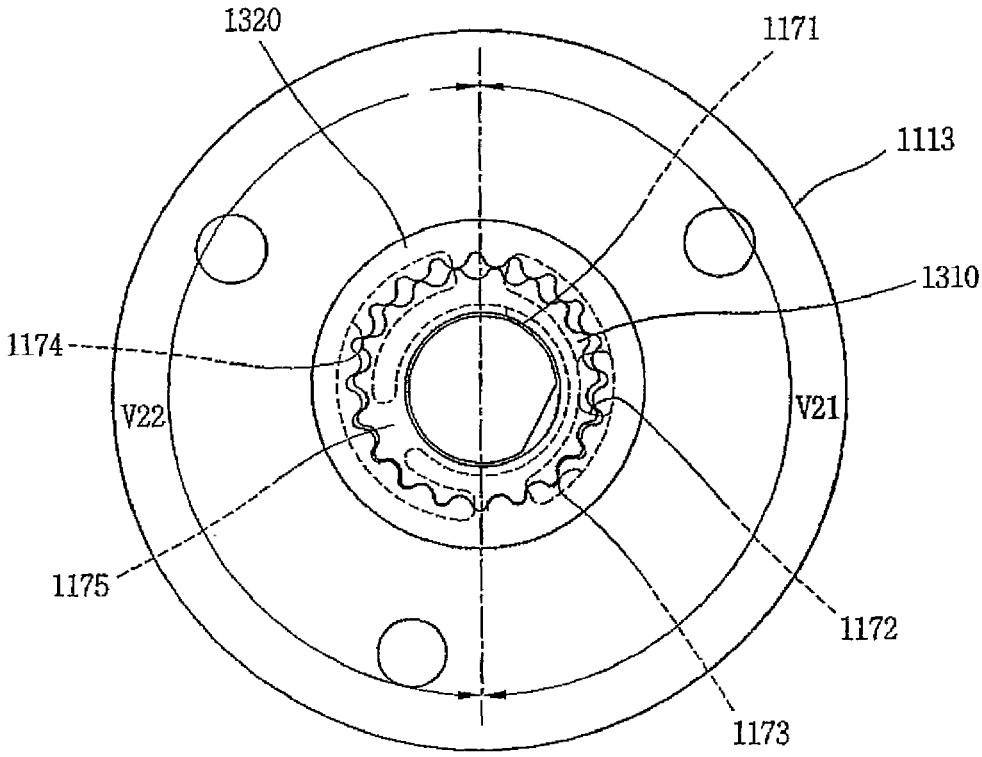
FIG. 15 is a plane view showing a second oil pump of the oil pumps of FIG. 13.

As shown in FIGS. 13 and 15, a communicating groove 1171 is formed in the central portion of the lower housing 1113 and is in communication with the oil passage 23*a* of the crankshaft 23. A second inlet 1172 is formed near one side of the communicating groove 1171 and is in communication with the oil suction pipe 400 disposed in an axial direction.

A second suction guiding groove 1173 is formed in the lower housing 1113 for allowing the second inlet 1172 to be in communication with a second suction capacity portion V21. The second suction capacity portion V21 is configured between the second inner gear 1310 and the second outer gear 1320 similar to the suction capacity portion V1 described above. The second suction guiding groove 1173 is formed in a semi-circular arcuate shape.

A second discharge guiding groove 1174 is in communication with second discharge capacity portion V22. The second discharge capacity portion V22 is configured between the second inner gear 1310 and the second outer gear 1320 similar to the discharge capacity portion V2 described above. The second discharge guiding groove 1174 is formed at a side opposite to the second suction guiding groove 1173. A second discharge slot 1175 is formed at an inner side wall surface of the second discharge guiding groove 1174. The second discharge slot 1175 is in communication the communicating groove 1171 to guide oil from the second discharge guiding groove 1174 toward the oil passage 23*a* of the crankshaft 23.

During operation of the compressor according to this exemplary embodiment, oil separated in the oil separator 200 is introduced into first suction capacity portion V11 by flowing through the oil recollecting pipe 300, the first inlet 11633 and the first suction guiding groove 1165. The oil in the first guiding groove 1165 is then introduced into the first discharge guiding groove 1166 by using the first discharge capacity portion V12. Once the oil in introduced into the first discharge guiding groove 1166, the oil is then discharged into the inner space of the casing 10 through the first discharge slot 1167.

Simultaneously, oil contained in the inner space of the casing 10 and oil recollected into the inner space of the casing 10 through the fist oil pump 1100 are all introduced into the second suction capacity portion V21 of the second oil pump 1200 by flowing through the oil suction pipe 400, the second inlet 1172, and the second suction guiding groove 1173. The oil in the second suction guiding groove 1173 is then introduced into the second suction guiding groove 1173 and moves to the second discharge capacity portion V22 so as to be introduced into the second discharge guiding groove 1174. The oil introduced into the second discharge guiding groove 1174 is then introduced into the communicating groove 1171 via the second discharge slot 1175. The oil introduced into the communicating groove 1171 is sucked into the oil passage 23*a* of the crankshaft 23 and is moved up through the oil passage 23*a* by a centrifugal force of the oil passage 23*a*. A portion of the sucked oil can be supplied to bearing surfaces and, at the same time, the remaining oil is dispersed at an upper end of the oil passage 23*a* to be introduced into the compressing unit 30. This process may be continuously repeated as the crankshaft 23 is rotated.

Accordingly, the oil separated in the oil separator 200 is guided into the oil passage 23*a* of the crankshaft 23 via the inner space of the casing 10. Because the oil separated in the oil separator 200 is not guided directly into the oil passage 23*a* of the crankshaft 23, but is first recollected into the inner case of the casing 10 to thereafter be guided into the oil passage 23*a* of the crankshaft 23, introduction of foreign materials in the flow path of the refrigeration cycle device can be prevented as they would accumulate at the surface of the oil and not be drawn into the oil passage 23*a*. As a result, a foreign material filtering device, which is typically disposed at a suction side of a compressor, can be eliminated, thereby effectively reducing a fabrication cost of the refrigerant cycle device.

Figure 16:
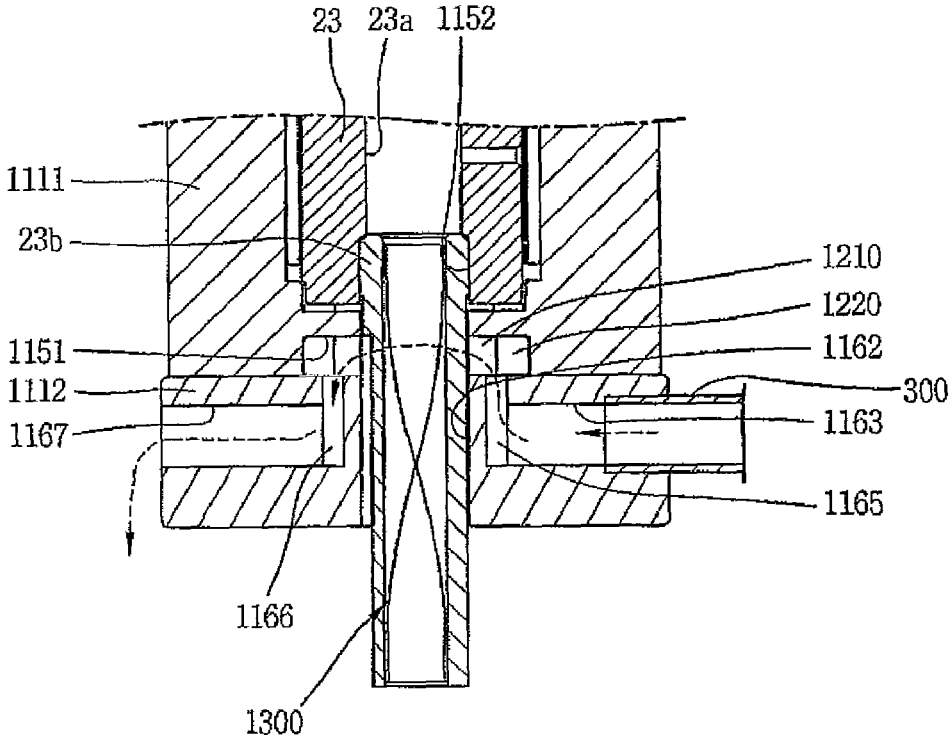
FIG. 16 is a longitudinal view showing another exemplary embodiment of the second oil pump useable with the hermetic compressor of FIG. 11.

Still another embodiment of a compressor according to the present invention will be described hereafter. While the aforementioned exemplary embodiment is configured such that the second oil pump is a volumetric pump, a third exemplary embodiment is provided, as shown in FIG. 16, where a second oil pump 1300 is an axial flow pump, such as a propeller pump. The first oil pump 1100 can be configured the same as that shown in FIGS. 13 and 14, and the second oil pump 1300 can be configured to be inserted into the pin potion 23*b* of the crankshaft 23. While the second oil pump 1300 of this exemplary embodiment may be provided with an insufficient amount of oil upon being driven at low speed as compared to the trochoid gear pump shown in the aforementioned embodiments, it is possible to reduce a fabricating cost of the second oil pump 1300 when used for a low capacity compressor.

Figure 17:
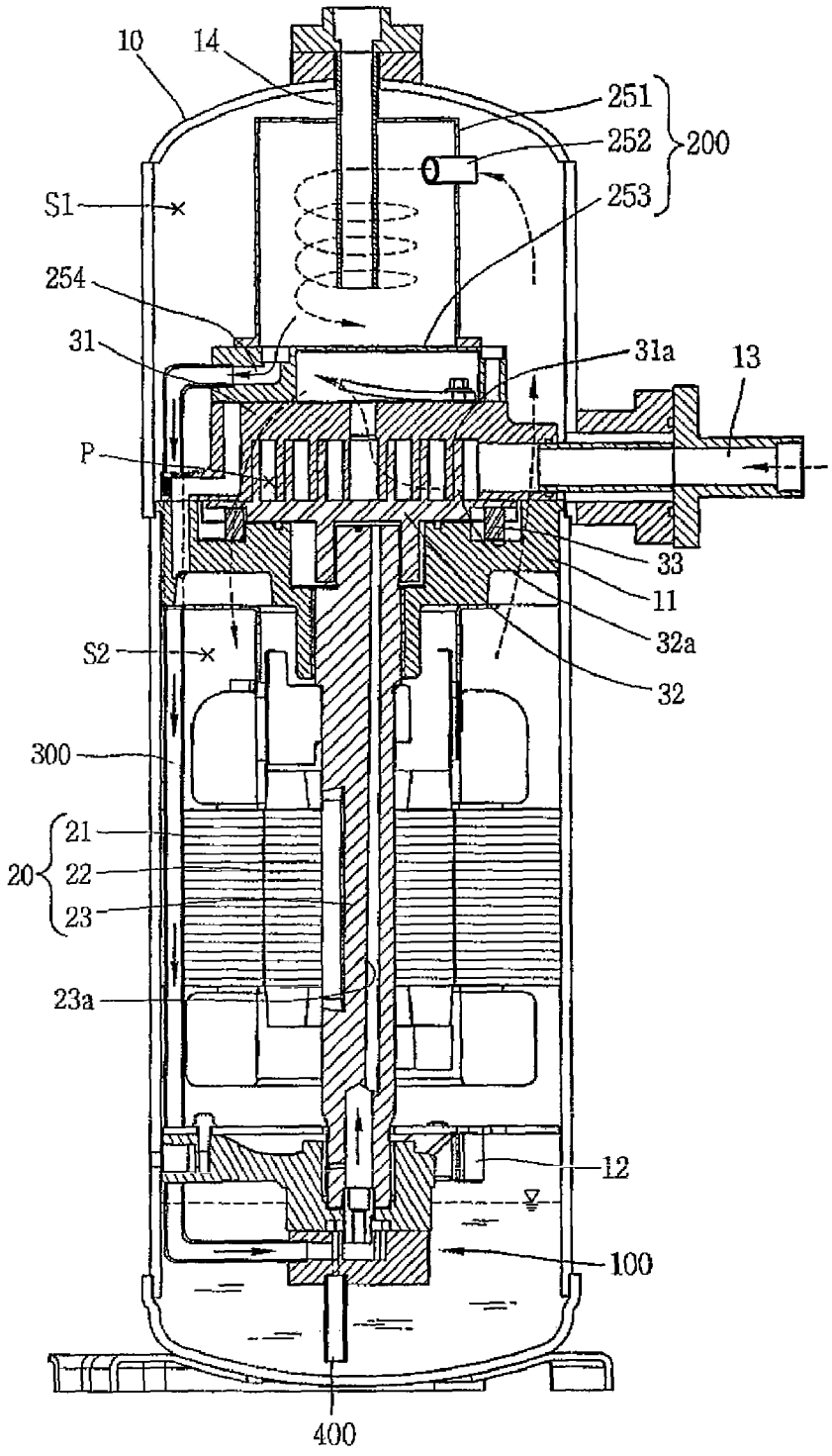
FIG. 17 is a longitudinal view showing another exemplary embodiment of a hermetic compressor useable in a refrigeration cycle device.

According to yet another exemplary embodiment of the present invention, the oil separating unit may be located at the inside of the casing of the compressor. For example, as shown in FIG. 17, the oil separator 200 includes an oil separating cap 251 fixedly installed in the inner space of the casing 10, an oil separating pipe 252 formed through one side wall surface of the oil separating cap 251 such that oil and refrigerant inside the casing 10 can be separated from each other while being introduced into the oil separating cap 251, and a separating cover 253 located between the compressing unit 30 and the oil separator 200 to separate the discharge side of the compression unit 30 from the oil separator. The oil separating cap 241 may be spaced apart from the inner surface of the casing 10 by a gap.

The discharge pipe 14 penetrates into the inner space of the oil separating cap 251 from an upper side of the oil separating cap 251, in particular, the separated space defined by the oil separating cap 251, to thereby be hermetically coupled thereto. An oil recollecting passage 254 is formed such that oil separated in the inner space of the oil separating cap 251 flows out of the oil separating cap 251 to then be recollected into the inner space of the casing 10. One end of the oil recollecting pipe 300 is connected to the oil recollecting passage 254. Another end of the oil recollecting pipe 300 is connected to the suction side of the oil pump 100 for forcibly pumping oil. Here, the oil pump 100 may be the same as the oil pump 100 in one of the aforementioned exemplary embodiments, particularly, that of FIG. 2, or be the same as that shown in FIG. 13 or 16.

Figure 3:
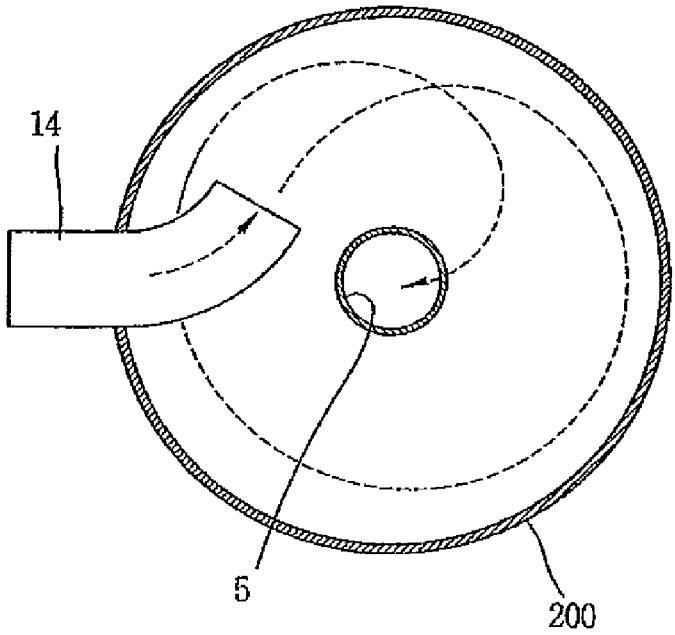
FIG. 3 is a cross-sectional view taken along the line I-I of FIG. 2.

The oil separating pipe 252 has an inlet in communication with an upper space S1 of the casing 10 and an outlet in communication with the inner space of the oil separating cap 251. The oil separating pipe 252 may be formed to be curved or bent, as similar to the discharge pipe 14 shown in FIG. 3, such that refrigerant and oil guided into the oil separating cap 251 are separated from each other while spirally orbiting together.

The processes of separating and recollecting oil in the scroll compressor according to the present invention are the same or similar to those illustrated in the aforementioned embodiments, detailed explanation of which will thusly be omitted. However, in this embodiment, because the oil separator 200 is installed inside the casing 10, the flowing direction of the refrigerant and oil is different from that in the previous embodiments. That is, refrigerant discharged from the compression chamber P flows to the lower space S2, which has the motor located therein, through an inlet side fluid passage (not shown), thereafter to flow to the upper space S1 through an outlet side fluid passage (not shown).

The discharged refrigerant is introduced into the oil separating cap 251 via the oil separating pipe 252 such that oil mixed with the refrigerant can be separated from the refrigerant while the oil and the refrigerant orbit in the oil separating cap 251. The oil-separated refrigerant moves to the remaining parts of the refrigeration cycle device via the discharge pipe 14, while the separated oil is recollected by the oil recollecting pump 100 into the oil passage 23*a* of the crankshaft 23 via the oil recollecting pipe 300. The process may be continuously repeated.

In case of installing the oil separator 200 inside the casing 10, the compressor can be integrally formed with the oil separator 200, so as to enable a simple configuration of the refrigeration cycle device including the compressor. Also, a pipe for connecting the oil separator to the compressor can be simplified to thusly further reduce the fabricating cost.

Figure 18:
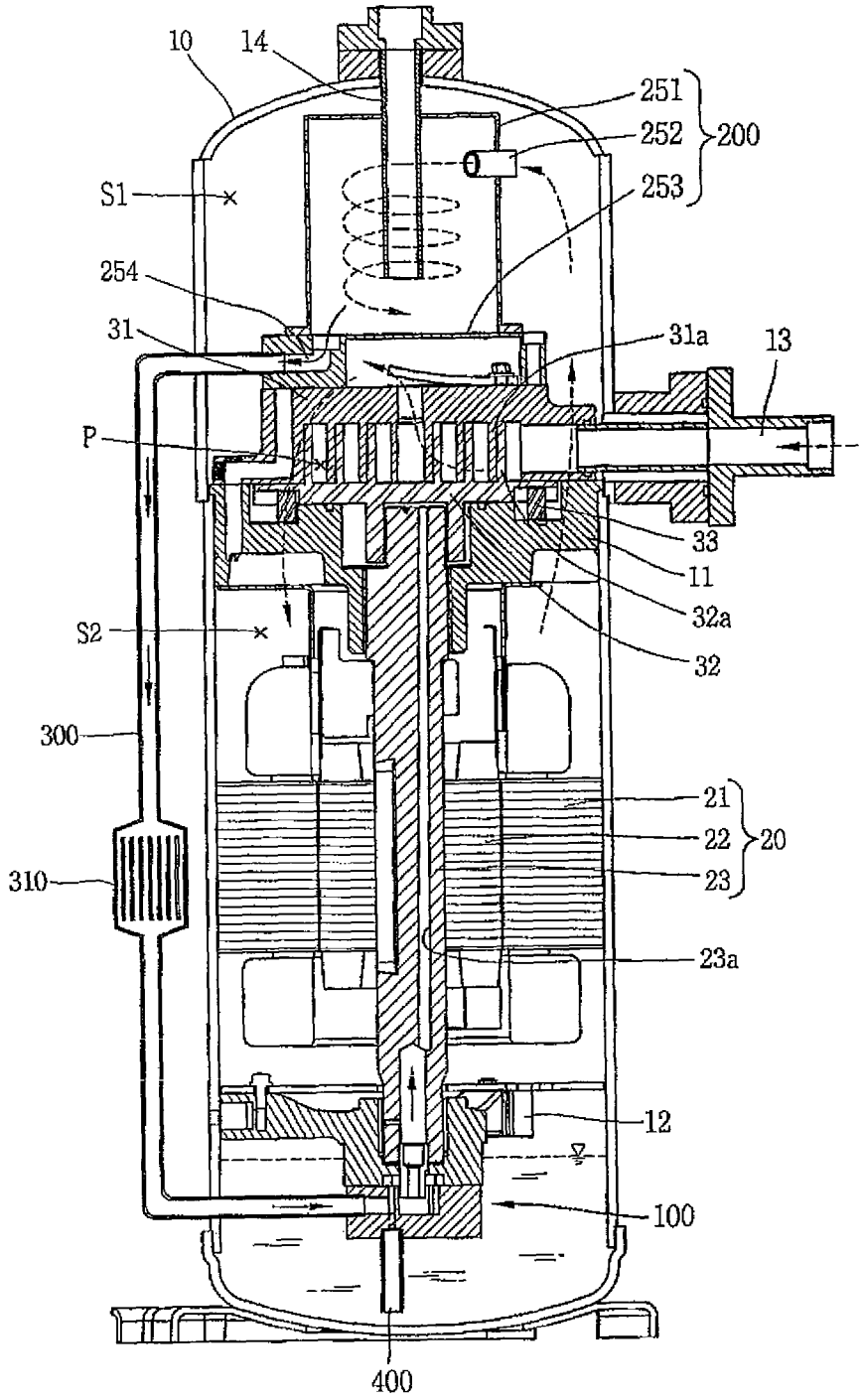
FIG. 18 is a longitudinal view showing another exemplary embodiment of a hermetic compressor useable in a refrigeration cycle device.

In still another exemplary embodiment of the present invention, as shown in FIG. 18, the compressor 1 may be configured to draw the oil recollecting pipe 300 out of the casing 10 to be then connected to the oil pump 100 by being inserted back into the casing 10. In this exemplary embodiment, a radiating member (not shown) or a capillary tube 310 for lowering an oil temperature may be formed at the intermediate portion of the oil recollecting pipe 300.

In the aforementioned embodiments, one oil separator is connected to one compressor. However, upon installing the oil separator outside the casing, such one oil separator can be connected to a plurality of compressors. Furthermore, even when a single oil separator is located inside a casing of one compressor, the oil separator can be connected to a plurality of compressors.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A compressor comprising:

a casing having an inner space;

a suction pipe connected to the casing;

a discharge pipe connected to the casing;

a motor located in the inner space of the casing to generate a driving force, the motor having a crankshaft;

a compressing unit located in the inner space of the casing, the compressing unit being driven by the motor to compress a refrigerant;

an oil separator configured to separate oil from a refrigerant discharged from the compressing unit; an oil recollecting pipe connected to the oil separator; and at least one oil pump configured to pump oil separated from the oil separator for recollection, wherein the at least one oil pump is directly connected to the oil recollecting pipe, and wherein the at least one oil pump is coupled to the crankshaft of the motor to be driven by a rotational force of the crankshaft, and wherein the at least one oil pump includes:

a pump housing having a first inlet and a second inlet formed thereat, the pump housing having a pumping space;

an inner gear rotatably located in the pumping space of the pump housing and coupled to the crankshaft to rotate therewith; and an outer gear rotatably located in the pumping space of the pump housing, the outer gear being engaged with the inner gear to form a variable capacity, wherein the pump housing includes:

a first suction guiding groove in communication with the first inlet, which is directly connected with the oil recollecting pipe;

a second suction guiding groove in communication with the second inlet, which is directly connected with the inner space of the casing, the first and second suction guiding grooves being separated from each other; and at least one discharge guiding groove located at a side of the pump housing opposite to the first and second suction guiding grooves, the at least one discharge guiding groove being in communication with the oil passage of the crankshaft.

2. The compressor of claim 1, wherein the at least one oil pump is configured to pump oil contained in the inner space of the casing.

3. The compressor of claim 1, wherein the at least one oil pump includes a first oil pump configured to recollect oil separated in the oil separator and a second oil pump configured to pump oil contained in the inner space of the casing.

4. The compressor of claim 3, wherein the second oil pump is a volumetric pump, the second oil pump being coupled to the crankshaft to generate a variable capacity and to pump oil using the variable capacity.

5. The compressor of claim 3, wherein the crankshaft includes an oil passage, and wherein the second oil pump is an axial pump, the second oil pump being coupled to the oil passage of the crankshaft to rotate in cooperation with the crankshaft so as to generate a pumping force.

6. The compressor of claim 1, wherein the oil separator is located outside the casing.

7. The compressor of claim 1, wherein the oil separator is located inside the casing.

8. The compressor of claim 7, wherein the oil separating unit includes:

an inner space; and an oil separating pipe to guide the separated oil, the oil separating pipe being bent or curved such that a refrigerant introduced into the inner space of the oil separating unit spirally orbits.

9. The compressor of claim 1, wherein the compressing unit includes:

a fixed scroll fixedly installed at the casing; and an orbiting scroll engaged with the fixed scroll and orbiting in cooperation with the motor, the fixed scroll and orbiting scroll defining at least one compression chamber.

10. The compressor of claim 1, wherein the inner space of the casing is a hermetic inner space.

11. The compressor of claim 1, wherein the at least one pump is a single pump that includes the first inlet and the second inlet, the single pump is configured such that oil pumped via the first inlet and oil pumped via the second inlet are mixed with each other to be guided into the oil passage of the crankshaft.

12. The compressor of claim 1, wherein the pump housing includes:

a communicating groove in communication with the oil passage of the crankshaft, the first and second suction guiding grooves and the discharge guiding groove being located around the communicating groove; and a discharge slot connecting the discharge guiding groove to the communicating groove.

13. The compressor of claim 12, wherein each of the first and second suction guiding grooves and the discharge guiding groove has an arcuate shape.

14. The compressor of claim 12, wherein the communicating groove includes a wall surface, the discharge guiding groove includes an inner circumferential surface, and the discharge slot extends between the inner circumferential surface of the discharge guiding groove and the wall surface of the communicating groove to allow oil to flow therethrough.

15. The compressor of claim 1, wherein the inner space of the casing is in communication with the suction pipe, and a discharge side of the compressing unit is in communication with the discharge pipe.

16. The compressor of claim 1, wherein a suction side of the compressing unit is in communication with the suction pipe, and the inner space of the casing is in communication with the discharge pipe.

17. A refrigeration cycle device comprising:

a compressor having a suction side and a discharge side, the compressor including:

a casing having an inner space;

a motor located in the inner space of the casing;

a crankshaft coupled to motor to be rotated by the motor;

a compressing unit located in the inner space of the casing and driven by the motor to compress a refrigerant;

a condenser connected to the discharge side of the compressor;

an oil separator located between the compressor and the condenser to separate oil from a refrigerant;

an oil recollecting pipe connected to the oil separator;

an expander connected to the condenser; and an evaporator connected between the expander and the suction side of the compressor, wherein at least one oil pump is located in the inner space of the casing of the compressor, the at least one oil pump being coupled to the crankshaft of the motor to be directly connected to the oil recollecting pipe so as to pump oil separated in the oil separator and simultaneously pump oil contained in the inner space of the casing, wherein the oil pump is coupled to the crankshaft of the motor to be driven by a rotational force of the crankshaft, and wherein the oil pump includes:

a pump housing having a first inlet and a second inlet formed thereat, the pump housing having a pumping space;

an inner gear rotatably located in the pumping space of the pump housing and coupled to the crankshaft to rotate therewith; and an outer gear rotatably located in the pumping space of the pump housing, the outer gear being engaged with the inner gear to form a variable capacity, wherein the pump housing includes:

a first suction guiding groove in communication with the first inlet, which is directly connected with the oil recollecting pipe;

a second suction guiding groove in communication with the second inlet, which is directly connected with the inner space of the casing, the first and second suction guiding grooves being separated from each other; and at least one discharge guiding groove located at a side of the pump housing opposite to the first and second suction guiding grooves, the at least one discharge guiding groove being in communication with the oil passage of the crankshaft.

18. The device of claim 17, wherein the crankshaft includes an oil passage formed therethrough, and wherein the at least one oil pump includes an outlet directly in communication with the oil passage of the crankshaft, the outlet being configured to allow oil separated in the oil separator to be supplied into the oil passage of the crankshaft.

19. The device of claim 18, wherein the oil recollecting pipe includes a foreign material filtering unit located in an intermediate portion of the oil recollecting pipe to filter foreign materials contained in the oil.

20. The device of claim 18, wherein the crankshaft includes an oil passage formed therethrough, wherein the at least one oil pump includes a plurality of oil pumps, and at least one of the plurality of oil pumps includes an inlet in communication with the inner space of the casing of the compressor, and wherein oil separated in the oil separator flows into the inner space of the casing of the compressor to be supplied into the oil passage of the crankshaft.

21. The device of claim 17, wherein the at least one oil pump includes a plurality of oil pumps, and at least one of the plurality of oil pumps includes an inlet in communication with the oil separator and an outlet in communication with the inner space of the casing such that oil separated in the oil separator flows into the inner spacing of the casing through the outlet.

* * * * *